US011300017B2

(12) United States Patent
Diederichs et al.

(10) Patent No.: US 11,300,017 B2
(45) **Date of Patent: *Apr. 12, 2022**

(54) HYDRAULIC VALVE FOR A CAM PHASER

(71) Applicant: ECO Holding 1 GmbH, Marktheidenfeld (DE)

(72) Inventors: Udo Diederichs, Nuertingen (DE); Michael Brumm, Herolstatt (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 28 days.

This patent is subject to a terminal disclaimer.

(21) Appl. No.: 16/271,845

(22) Filed: Feb. 10, 2019

(65) Prior Publication Data

US 2019/0257223 A1 Aug. 22, 2019

(30) Foreign Application Priority Data

Feb. 21, 2018 (DE) ..... 10 2018 103 915.8
Jan. 17, 2019 (DE) ..... 10 2019 101 115.9

(51) Int. Cl.
*F01L 1/344* (2006.01)
*F01L 1/02* (2006.01)
*F01L 1/24* (2006.01)

(52) U.S. Cl.
CPC ..... *F01L 1/3442* (2013.01); *F01L 1/02* (2013.01); *F01L 1/34409* (2013.01);
(Continued)

(58) Field of Classification Search
CPC ..... F01L 1/3442; F01L 1/02; F01L 1/34409; F01L 2001/2438; F01L 2001/34426;
(Continued)

(56) References Cited

U.S. PATENT DOCUMENTS

2009/0178635 A1* 7/2009 Takenaka ..... F01L 1/3442 123/90.17
2015/0218976 A1* 8/2015 Last ..... F01L 1/3442 123/90.15

(Continued)

FOREIGN PATENT DOCUMENTS

CN 104110266 A 10/2014
CN 107100690 A 8/2017

(Continued)

*Primary Examiner* — Devon C Kramer
*Assistant Examiner* — Kelsey L Stanek
(74) *Attorney, Agent, or Firm* — Von Rohrscheidt Patent

(57) ABSTRACT

A hydraulic valve for a cam phaser, the hydraulic valve including a bushing including a piston that is movable in a bore along a longitudinal direction; a supply connection configured to feed a hydraulic fluid; a first operating connection and a second operation connection; and a first tank drain connection and a second tank drain connection configured to drain the hydraulic fluid; and a first check valve associated with the first operating connection and a second check valve associated with the second operating connection, wherein the first operating connection and the second operating connection are connectable through at least one of the first check valve and the second check valve alternatively with each other or with the supply connection or with one of the first tank drain connection and the second tank drain connection by moving the piston, wherein the hydraulic valve includes five switching positions.

18 Claims, 6 Drawing Sheets

(52) U.S. Cl.
CPC ..... *F01L 2001/2438* (2013.01); *F01L 2001/34426* (2013.01); *F01L 2001/34483* (2013.01)

(58) Field of Classification Search
CPC ..... F01L 2001/34483; Y10T 137/7845; Y10T 137/7925; Y10T 137/7929; Y10T 137/7779; Y10T 137/778; F16K 15/026; F16K 15/028; F16K 17/0413; F16K 17/0473; F16K 17/048; F16K 17/26
USPC ..... 123/90.17; 137/512.5, 512, 513, 538, 137/540, 493.9, 493.8
See application file for complete search history.

(56) References Cited

U.S. PATENT DOCUMENTS

| | | | | |
|---|---|---|---|---|
| 2015/0300213 | A1* | 10/2015 | Kaufmann | F16K 11/10 137/625.42 |
| 2017/0260882 | A1* | 9/2017 | Brower | F16K 15/026 |
| 2019/0107014 | A1* | 4/2019 | Smith | F01L 1/3442 |

FOREIGN PATENT DOCUMENTS

| | | | | |
|---|---|---|---|---|
| DE | 102006012775 | A1 | 9/2007 | |
| DE | 102008055175 | A1 | 7/2009 | |
| DE | 102010005604 | A1 | 7/2011 | |
| DE | 102013104031 | A1 * | 10/2014 | F01L 1/3442 |
| DE | 102013104031 | A1 | 10/2014 | |
| EP | 1291563 | A2 | 3/2003 | |
| EP | 2375014 | A1 | 10/2011 | |
| EP | 2905434 | A1 | 8/2015 | |

* cited by examiner

HYDRAULIC VALVE FOR A CAM PHASER

RELATED APPLICATIONS

This application claims priority from and incorporates by reference German patent applications
DE 10 2018 103 915.8, filed on Feb. 21, 2018, and
DE 10 2019 101 115.9, filed on Jan. 17, 2019.

FIELD OF THE INVENTION

The invention relates to a hydraulic valve, in particular for a cam phaser of an internal combustion engine of a motor vehicle. Furthermore, the invention relates to a valve for a cam phaser and to a method for operating the valve for the cam phaser.

BACKGROUND OF THE INVENTION

The cam phaser system disclosed in DE 10 2006 012 775 A1 includes pressure chambers of a rotor that are provided with check valves so that pressure spikes that occur during quick adjustment can be used.

EP 2 375 014 A1 discloses check valves that take advantage of alternating cam shaft torques and that are integrated into the central valve in that band check valves are attached at an inside of a bushing. At the two operating connections and at the supply connection of the bushing, a respective band check valve presses from an inside against the interior of the bushing. When sufficient pressure is applied to the corresponding connection, the band check valve opens so that hydraulic fluid that flows into the central valve at one operating connection can be supplied to the other operating connection together with hydraulic fluid from the supply connection. Starting from a center position of the central valve initially a switching position is proportionally controllable in which the pressure spikes of the operating connection to be unloaded are blocked relative to the operating connection that is to be loaded. In each connection another switching position is controllable in order to utilize the alternating cam torques.

BRIEF SUMMARY OF THE INVENTION

Thus, it is an object of the invention to provide a hydraulic valve which has a simple and compact configuration and facilitates better system properties of a cam phaser. Additionally it is an object of the invention to provide an efficient concept of a valve and of a method for operating a valve of a cam phaser which improve cold operating properties.

The recited objects are achieved according to the independent claims.

Advantageous embodiments and advantages of the invention can be derived from the dependent claims, the description and the drawing figure.

A hydraulic valve is proposed, in particular for a cam phaser, the hydraulic valve comprising a bushing including a piston that is movable in a bore along a longitudinal direction, a supply connection for feeding a hydraulic fluid and at least a first operating connection and a second operation connection. The hydraulic valve includes at least a first tank drain connection and a second tank drain connection configured to drain the hydraulic fluid, wherein a respective check valve is associated with the first operating connection and the second operating connection, and the first operating connection and the second operating connection are connectable through at least one of the check valves alternatively with each other and/or with the supply connection and/or with one of the tank drain connections by moving the piston. According to the invention, the hydraulic valve includes five switching positions wherein the second operating connection is connected with the supply connection and the first operating connection is connected with the first tank drain connection in a first switching position of the piston, wherein a fluid path from the first operating connection to the second operating connection is openable by the check valve that is associated with the first operating connection under a pressure that exceeds a threshold value. The second operating connection is connected with the supply connection and a connection between the first operating connection and the first tank drain connection is interrupted in a second switching position of the piston wherein a fluid path from the first operating connection to the second operating connection is openable by the check valve that is associated with the first operating connection under a pressure that exceeds a threshold value. Wherein a connection between the operating connections and the supply connection and the tank drain connections is interrupted in a third switching position of the piston which is positioned in a center position. The first operating connection is connected with the supply connection and a connection between the second operating connection and the second tank drain connection is interrupted in a fourth switching position of the piston wherein a fluid path from the second operating connection to the first operating connection is openable by a check valve that is associated with the second operating connection under a pressure that exceeds a threshold value. The first operating connection is connected with the supply connection and the second operating connection is connected with the second tank drain connection in a fifth switching position of the piston, wherein a fluid path from the second operating connection to the first operating connection is openable by the check valve that is associated with the second operating connection under a pressure that exceeds a threshold value.

Pulsating hydraulic pressures generate alternating torques at the hydraulic piston, wherein the alternating torques have a positive variable portion at times and a negative variable portion at times. On the other hand side, surging torques are torques that change their absolute amounts, but remain in the same prefix range of the torque diagram over a longer time period of several milliseconds.

An external torque that is either alternating or surging impacts a motor vehicle hydraulic loop of a cam phaser with a counteracting hydraulic piston and with at least two hydraulic chambers. The hydraulic loop causes a position change based on different pressure loadings of the counteracting hydraulic chambers that are supplied by the hydraulic pump. In addition to a hydraulic switch adjustment, advantageously embodied by a valve, which conducts the pressure loading through the hydraulic fluid onto the piston, a negative portion of the alternating torque is used to adjust a position of the hydraulic piston. The surging portion of the torque, however, is cancelled by additional devices like, e.g., check valves. The selective utilization of torques, in particular through the release by check valves, provides a linearization of the adjustment speed over the speed of the engine, whereas the ongoing utilization of a minimum size hydraulic supply from a pump for adjusting the piston also provides the high adjustment speed also under pure surge portions of the torque.

For example, respective hydraulic connection paths can be provided from one chamber of the cam phaser to the operating connection for the other chamber. This yields a hydraulic loop with a valve. The valve can conduct the hydraulic pressure to the second operating connection of the respective other chamber since the hydraulic pressure is conductible from a negative portion of the alternating torque at the first operating connection for a respective chamber can be bled off through at least one check valve. An alternating pass through conduction can be provided. Furthermore, the pressure loading of the pressure loaded connection is passed on to the second operating connection. The pass-through conduction of the hydraulic fluid is performed from the first chamber and also from the second chamber to the corresponding counteracting chamber. The function of the check valves can be designated as a bypass which only feeds back the negative portion of the alternating force upstream of the cam phaser. A suitable location for the back feeding can be the supply connection of the cam phaser. Thus, the check valves can be arranged so that a pass-through conduction of the hydraulic pressure from the chambers of the pistons is only facilitated in a direction towards the pressure side of the cam phaser, starting with a predetermined threshold value.

According to an advantageous embodiment of the invention, a respective check valve is associated with the first operating connection and the second operating connection on an outside of the piston. This facilitates a compact configuration of the hydraulic valve.

Advantageously the check valves are respectively arranged at a piston attachment which envelopes the piston and is fixed at the piston. This way the piston assembly can be configured in a simple and cost-effective manner.

According to an advantageous embodiment, the check valves are configured as disc-shaped closing elements which are preloaded by a common compression spring against the piston attachments. Thus, a pre-assembled module can be provided which can be mounted into the bushing easily.

The piston attachments advantageously have two annular bars which respectively include two control edges that cooperate with recesses in the bushing. These control edges facilitate an improved control of the volume flow of the hydraulic fluid so that a significant increase of the adjustment speed is achieved, in particular in a higher engine speed range, and an improved function in the lower temperature range.

According to an advantageous embodiment, the control edges of the annular bars cooperate with the operating connections configured as radial recesses in the bushing and with two groove-shaped recesses in the borehole, wherein the groove-shaped recesses are arranged in the axial direction respectively between the operating connection and the associated tank drain connection. The groove-shaped recesses facilitate a position independent opening and closing of the tank drain connections in cooperation with the control edges, so that the hydraulic valve has pure so-called fast-phaser characteristics in the control range (conducting the hydraulic fluid from one chamber into the other chamber without tank drain) and has fast-phaser characteristics with tank drain in the end positions.

According to another aspect of the invention, a valve is proposed for a cam phaser, the valve comprising a bushing including a piston that is movably arranged in a bore along a longitudinal direction between a first end position and a second end position; a supply connection for feeding a hydraulic fluid; at least a first operating connection and a second operating connection and at least a first tank drain connection and a second tank drain connection for draining the hydraulic fluid, wherein the first operating connection and the second operating connection are flow connectable with each other by a suitable positioning of the piston, and the piston includes outer annular bars that are arranged at outer axial ends of the piston in order completely close the tank drain connection in the first end position and to completely close the tank drain connection in the second end position. This achieves the technical advantage that on the one hand side the so-called fast-phaser function as well as an improved function can be assured in the lower temperature range in a valve. In an embodiment hydraulic connection paths from one chamber are provided through a valve into a counteracting chamber in a vane-type cam phaser. As a function of control properties of the valve, the connection paths can be used for alternating flow-through wherein hydraulic fluid flows out of the first chamber and flows into the second chamber of the vane-type cam phaser. Accordingly, the fluid can also flow out from the second chamber and flow into the first chamber. In order to accelerate system properties of the cam phaser, the fast-phaser function provides a bypass which facilitates a quick routing of the fluid directly from the first chamber into the second chamber or vice-versa. Through the check valves it can be additionally implemented that the bypass function is only enabled starting with a particular threshold value. The improved function in the lower temperature range results from the arrangement of the outer annular bars according to the invention which completely close the respectively associated tank drain connection in the end positions of the piston, but release the opposite tank drain connection instead. Releasing the opposite tank drain connection, for example, has the advantage that oil exchange also works well with highly viscous cold oil. Overall, the valve according to the invention yields a slightly reduced adjustment speed in a lower engine speed range compared to a pure fast-phaser valve. Additionally, a much increased adjustment speed is achieved in the upper engine speed range and the already recited improved function in the lower temperature range.

In order to precisely control the closing and releasing of the tank drain connections, the bushing includes two groove-shaped recesses in the portion of the borehole, wherein the groove-shaped recesses are respectively associated with the outer annular bars. The annular gap that is formable between an outer annular bar and an associated groove-shaped recess facilitates controlling the fluid flow. The groove-shaped recesses are, for example, configured wider that a wall thickness of the outer annular bars. This facilitates precisely controlling a flow-through volume of the fluid, as long as an outer annular bar is arranged in a portion of the groove-shaped recess. As soon as an outer annular bar is positioned in front or behind the groove-shaped recess, the respective tank drain connection is closed.

According to an advantageous embodiment, the groove-shaped recesses are arranged in the longitudinal direction respectively between the operating connection and the associated tank drain connection. This implements, e.g., a particularly compact embodiment of the valve.

In order to also provide the desirable fast-phaser function of the valve, the piston includes two inner annular bars between the outer annular bars wherein the two inner annular bars are respectively associated with the first operating connection and the second operating connection. The inner annular bars are offset inward from the outer annular bars in the longitudinal direction of the piston. The inner annular bars are configured wider than the outer annular bars since they have to completely close the operating connections as a function of position. Check valves are arranged directly at the inner annular bars wherein the check valves determine a threshold value that releases the bypass.

According to an advantageous embodiment, the piston is movable into a first Position where both tank drain connections are closed by the outer annular bars. The second operating connection is fluid connectable with the supply connection and the first operating connection is fluid connectable with the second operating connection. The first position is part of the classic control range of a fast-phaser valve. The tank drain connections are closed. In order to be able to connect the operating connection with the second operating connection (fast-phaser function), a particular threshold value has to be exceeded in order for the associated check valve to open, so that a fluid flows directly from the first operating connection to the second operating connection.

In order to cut off any fluid flow and in order to facilitate a stable operating condition of an internal combustion engine at constant speed, the piston is movable into a second position, wherein both tank drain connections are closed by the annular bars and the first operating connection and the second operating connection are respectively closed by the inner annular bars.

According to another embodiment, the piston is movable into a third position where both tank drain connections are closed by the outer annular bars. The first operating connection is flow connectable with the supply connection and the first operating connection is flow connectable with the second operating connection.

According to another aspect of the invention, the object is achieved by a method of operating a valve according to one of the recited embodiments. Thus, the tank drain connection is completely closed by an outer annular bar in the first end position. The tank drain connection is released by an annular gap between an outer annular bar and a groove-shaped recess, and the first operating connection is flow connected with the second operating connection. Additionally, the second operating connection is flow connected with the supply connection. Advantages achieved by the method for operating the valve are comparable to the advantages that are achieved by the valve or the hydraulic valve. The advantages relate on the one hand side to improving the so-called fast-phaser function as well as an improved function in a lower temperature range within the valve. In order to accelerate the system response of the cam phaser, the method provides a fast-phaser function through a bypass, which facilitates a quick routing of the fluid directly from the first chamber into the second chamber or vice versa. An improved function in the lower temperature range results from operating the valve according to the invention with the outer annular bars which completely close the respectively associated tank drain connection in the end positions of the piston but release the opposite tank drain connection. Releasing the opposite tank drain connection has, for example, the advantage that oil exchange also works well for highly viscous cold oil. Overall, the method according to the invention yields a slightly reduced adjustment speed in the lower engine speed range compared to operating a pure fast-phaser valve. Additionally, a significant increase of the adjustment speed is obtained in the upper speed range and the improved function in the lower temperature range that has already been described supra.

An advantageous embodiment relates to the method for operating the valve, wherein the tank drain connections are completely closed by the outer annular bars in a first position. Furthermore, the first operating connection is fluid flow connected with the second operating connection and the second operating connection is fluid flow connected with the supply connection. This yields e.g. the technical advantage that the valve is exclusively arranged in the control range of a fast phaser function wherein leakage in a direction towards the tank drain connections is suppressed.

In another embodiment the tank drain connections are completely closed by the outer annular bars in a second position, and the first operating connection and the second operating connection B are respectively fluid flow connected by the inner annular bars. This achieves e.g. the technical advantage that the fluid flow is suppressed and a stable operating condition is achieved.

In the third position the tank drain connections are completely closed by the outer annular bars, the first operating connection is fluid flow connected with the second operating connection and the first operating connection is fluid flow connected with the supply connection.

According to another embodiment the tank drain connection is completely closed by an outer annular bar in the second end position and the tank drain connection is released by an annular gap between an outer annular bar and a groove shaped recess.

In order to configure the functionality of the valve in a particularly efficient manner the piston is continuously movable between the first end position and a second end position.

BRIEF DESCRIPTION OF THE DRAWINGS

Further advantages can be derived from the subsequent drawing description. The drawing figures illustrate an embodiment of the invention. The drawing figures, the description and the claims include several features in combination. A person skilled in the art will also view the features individually and will combine them into other useful combinations, wherein

DETAILED DESCRIPTION OF THE INVENTION

Figure 1:
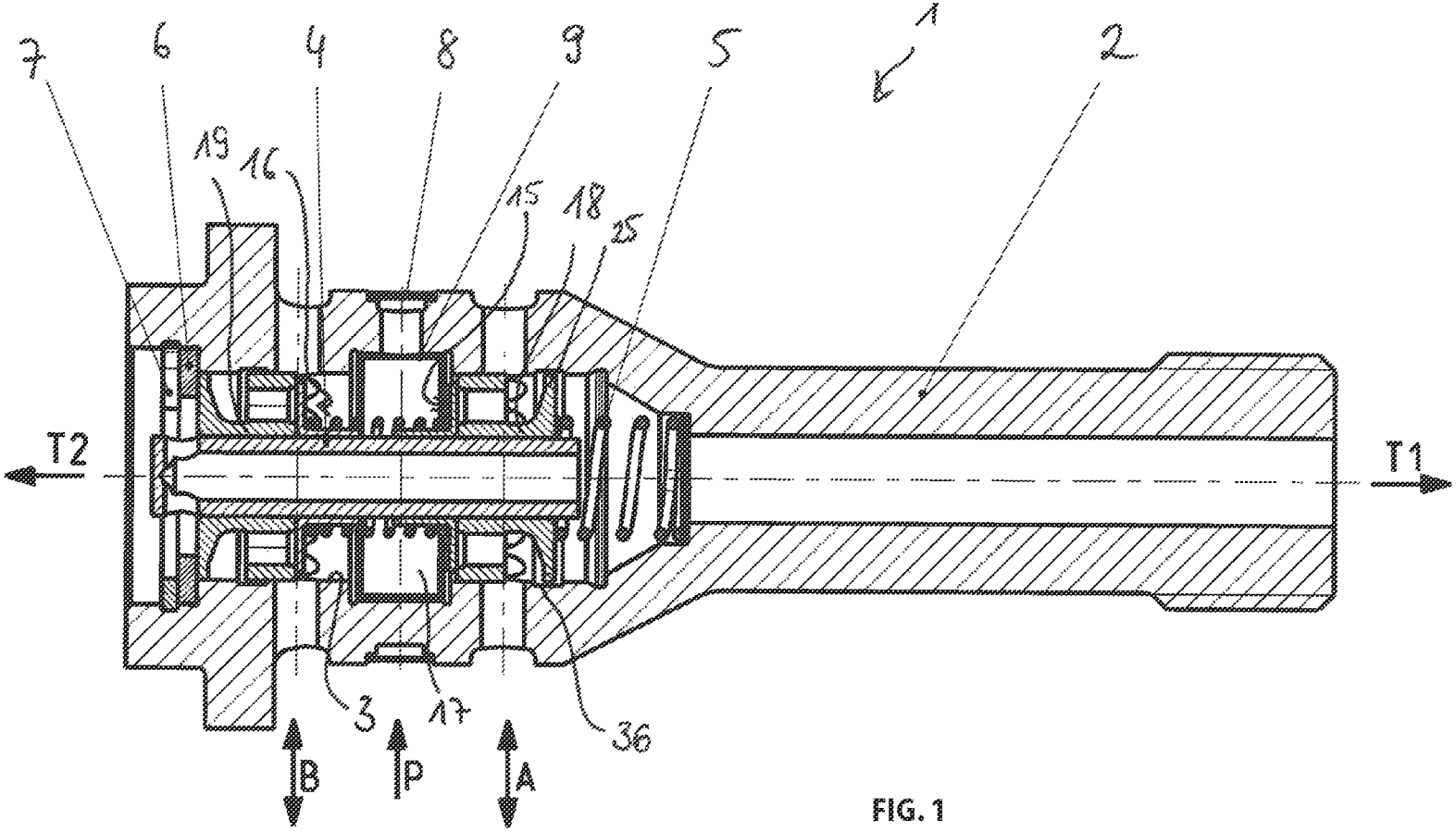
FIG. 1 illustrates a hydraulic valve configured to adjust a cam phaser according to an embodiment of the invention in a first switching position illustrated in a longitudinal sectional view.
Figure 3:
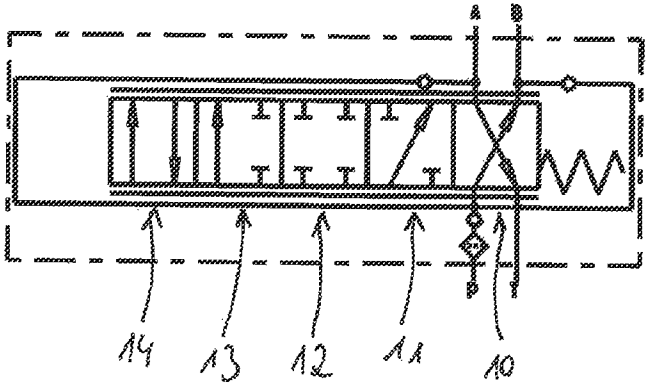
FIG. 3 illustrates a switching diagram of the hydraulic valve according to FIG. 1.
Figure 2:
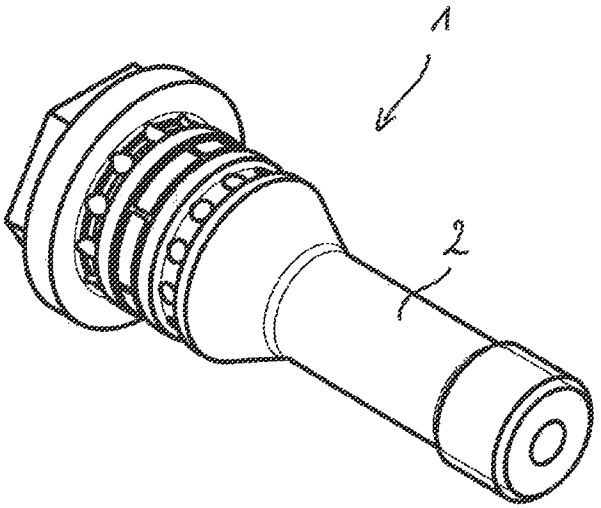
FIG. 2 illustrates the hydraulic valve according to FIG. 1 in a perspective view.
Figure 4:
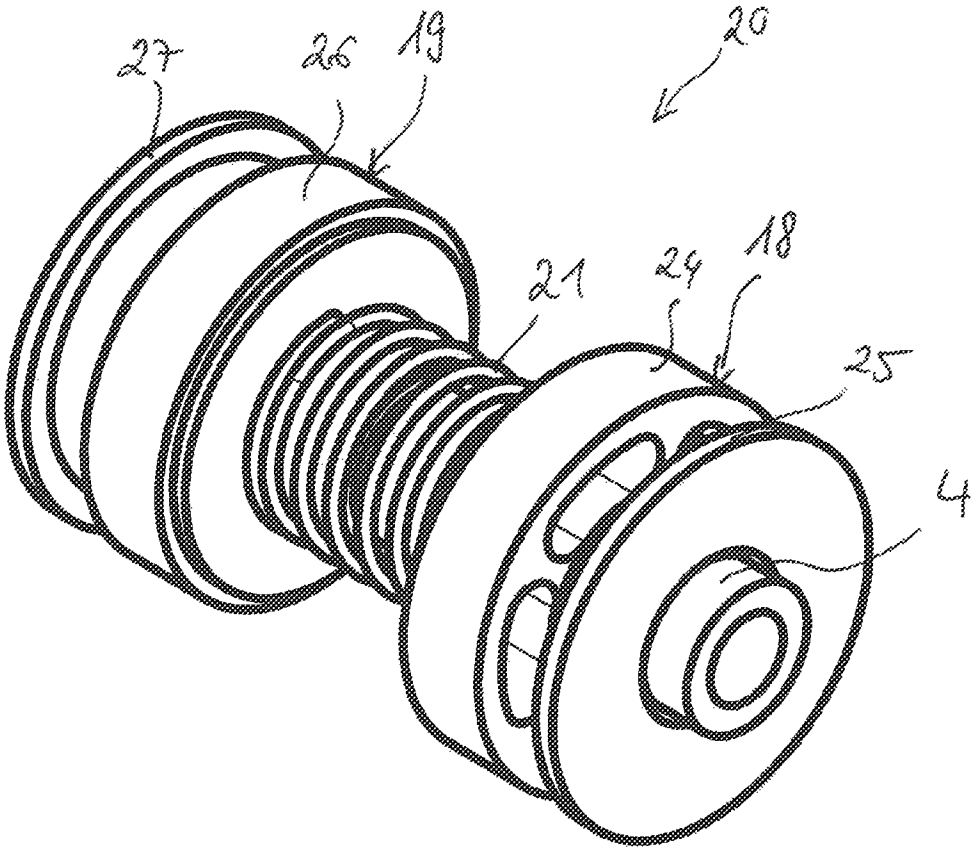
FIG. 4 illustrates a piston assembly of the hydraulic valve according to FIG. 1 in a perspective view.

In the drawing figures identical or like components are provided with identical reference numerals. The drawing figures merely show embodiments and do not limit the sprit and scope of the invention.

FIG. 1 illustrates a hydraulic valve 1 for adjusting a non-illustrated cam phaser according to an embodiment of the invention in a first switching position 10 in a longitudinal sectional view. The hydraulic valve 1 includes a bushing 2 with a piston 4 that is movably arranged in a longitudinal direction L in a bore 3. The piston 4 is supported by a compression coil spring 5 at the bushing 2 or supported at a disc 6 that is arranged by a ring 7 in the bushing 2.

The bushing 2 includes a supply connection P for feeding a hydraulic fluid and a first operating connection A and a second operating connection B that are respectively provided as a radial recess or plural radial recesses in the bushing in the sequence A-P-B. The supply connection P is protected against contamination by a screen 8 that is externally arranged at the bushing 2. Furthermore a band check valve 9 is arranged on an interior side of the bushing in a portion of the supply connection in order to prevent a flow back of hydraulic fluid in a direction towards the pump.

The hydraulic valve 1 includes a first and a second tank drain connection T1, T2 for draining the hydraulic fluid wherein both connections are respectively configured axially. The first operating connection A and the second operating connection B are respectively associated with a check valve 15, 16 wherein the first operating connection A and the second operating connection B are alternatively connectable with each other and/or with the supply connection P and/or with one of the tank drain connections T1, T2 through at least one of the check valves 15, 16 by moving the piston 4.

It is feasible according to the invention to provide only a single tank drain T at the valve. Thus, for example the hydraulic fluid that is drained towards the tank can be drained through the piston 4. The described tank drain connections T1 and T2 are interpreted in this case as a tank drain that is associated with the respective operating connection A or B, wherein both are run out of the valve by the only tank drain connection T.

According to the invention the hydraulic valve 1 includes five switching positions 10-14, wherein the second operating connection B is connected through the bore hole 3 and an annular cavity 17 configured therein about the piston 4 with the supply connection P in the first switching position 10 of the piston 4 illustrated in FIG. 1 and the first operating connection A is connected through the bore hole 3 and another fluid path between a first piston attachment 18 and an interior of the bushing with the first tank drain connection T1 as will be described in more detail infra.

An outer annular bar 27 closes a second tank drain opening 22 completely on an opposite side of the piston 4. The first switching position can also be interpreted as a first end position of the piston 4.

When a pressure applied to the first operating connection A exceeds a predetermined threshold value an additional fluid path is openable from the first operating connection A to the second operating connection B through the check valve 15 that is associated with the first operating connection A and the hydraulic fluid is passed through with fast phaser characteristics to the second operating connection B.

In a second switching position 11 of the piston 4 the second operating connection B is connected with the supply connection P and a connection between the first operating connection A and the first tank drain connection T1 is interrupted by the piston attachment 18, in particular by the outer annular bar 25, wherein the fluid path from the first operating connection A to the second operating connection B is openable by the check valve 15 that is associated with the first operating connection in this position. By the same token the tank drain connection T2 is closed by the annular bar 27 which is arranged at the piston attachment 19. In this position the hydraulic valve 1 has pure fast phaser characteristics. This second switching position can also be interpreted as a first position of the piston 4 within the control range of the fast phaser characteristics.

In a third switching position 12 the piston 4 is positioned in a center position in which a connection between the operating connections A, B and the supply connection P and the tank drain connections T1, T2 is completely interrupted. This third switching position can also be interpreted as a second position of the piston 4 within the control range of the fast phaser characteristics.

In a fourth switching position 13 of the piston 4 the first opening connection A is connected with the supply connection P and a connection between the second operating connection B and the second tank drain connection T2 is interrupted by a second piston attachment 19, in particular by the outer annular bar 27. A fluid path from the second operating connection B to the first operating connection A is openable by the check valve 16 that is associated with the second operating connection B through a pressure that exceeds a threshold value. By the same token the tank drain connection T1 is closed by the annular bar 25 that is arranged at the piston attachment 18. This third switching position can also be interpreted as a third position of the piston 4 within the control range of the fast phaser characteristics.

In a fifth switching position the piston 4 is arranged in a second end position where the first operating connection A is connected by the bore hole 3 and an annular cavity 17 configured therein about the piston 4 with the supply connection P and the second operating connection B is connected through the bore hole 3 and a fluid path between the second piston attachment 19 and an inside of the bushing with the second tank drain connection T2 as will be described in more detail infra. On an opposite side of the piston 4 an outer annular cavity 25 completely closes the second tank drain connection T1. The fifth switching position can also be interpreted as a second end position of the piston 4.

When a pressure applied to a second operating connection B exceeds a particular threshold value, a fluid path from the second operating connection B to the first operating connection A is openable through the check valve 16 that is associated with the operating connection B.

Figure 5:
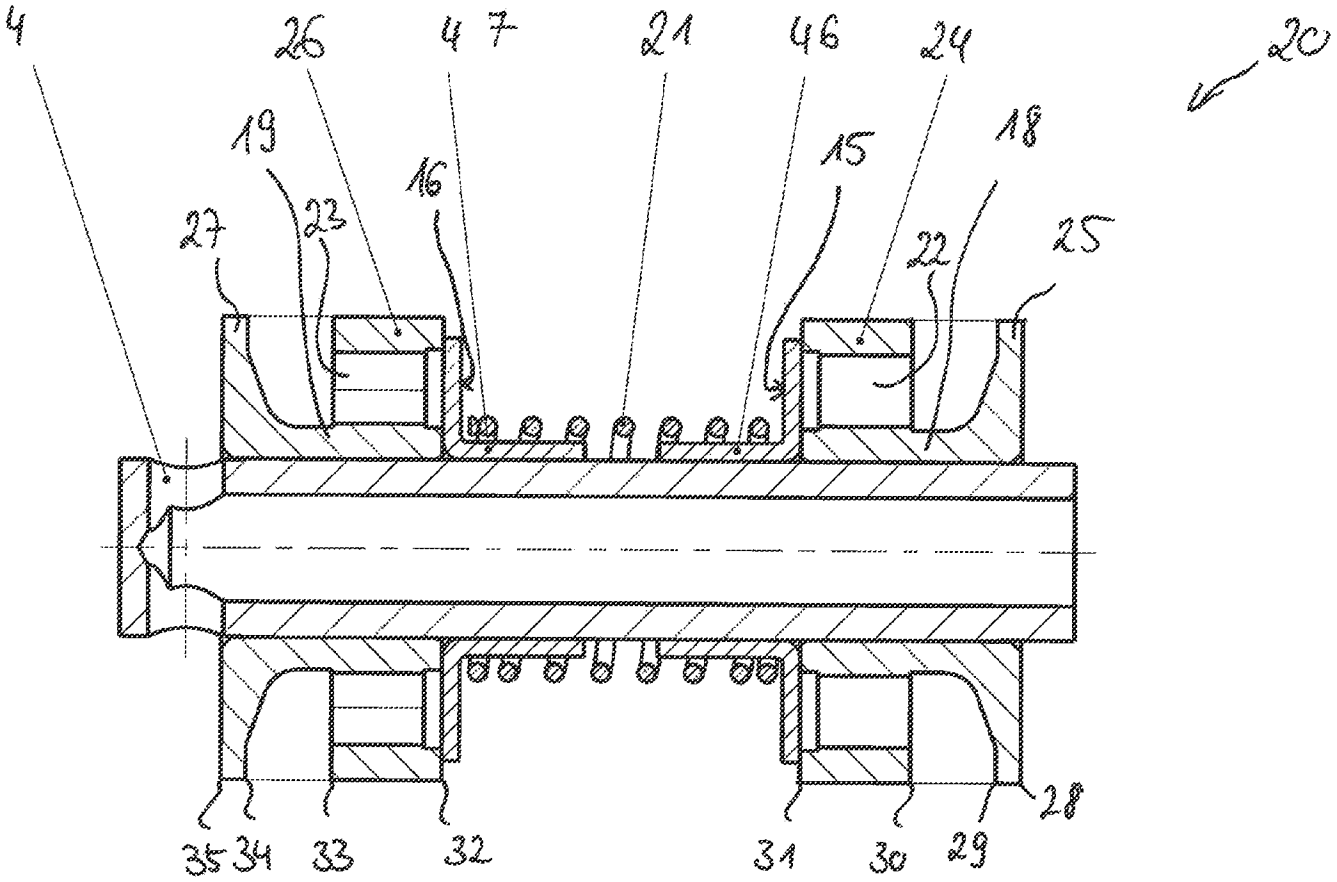
FIG. 5 illustrates a piston assembly according to FIG. 4 in a longitudinal sectional view.
Figure 6:
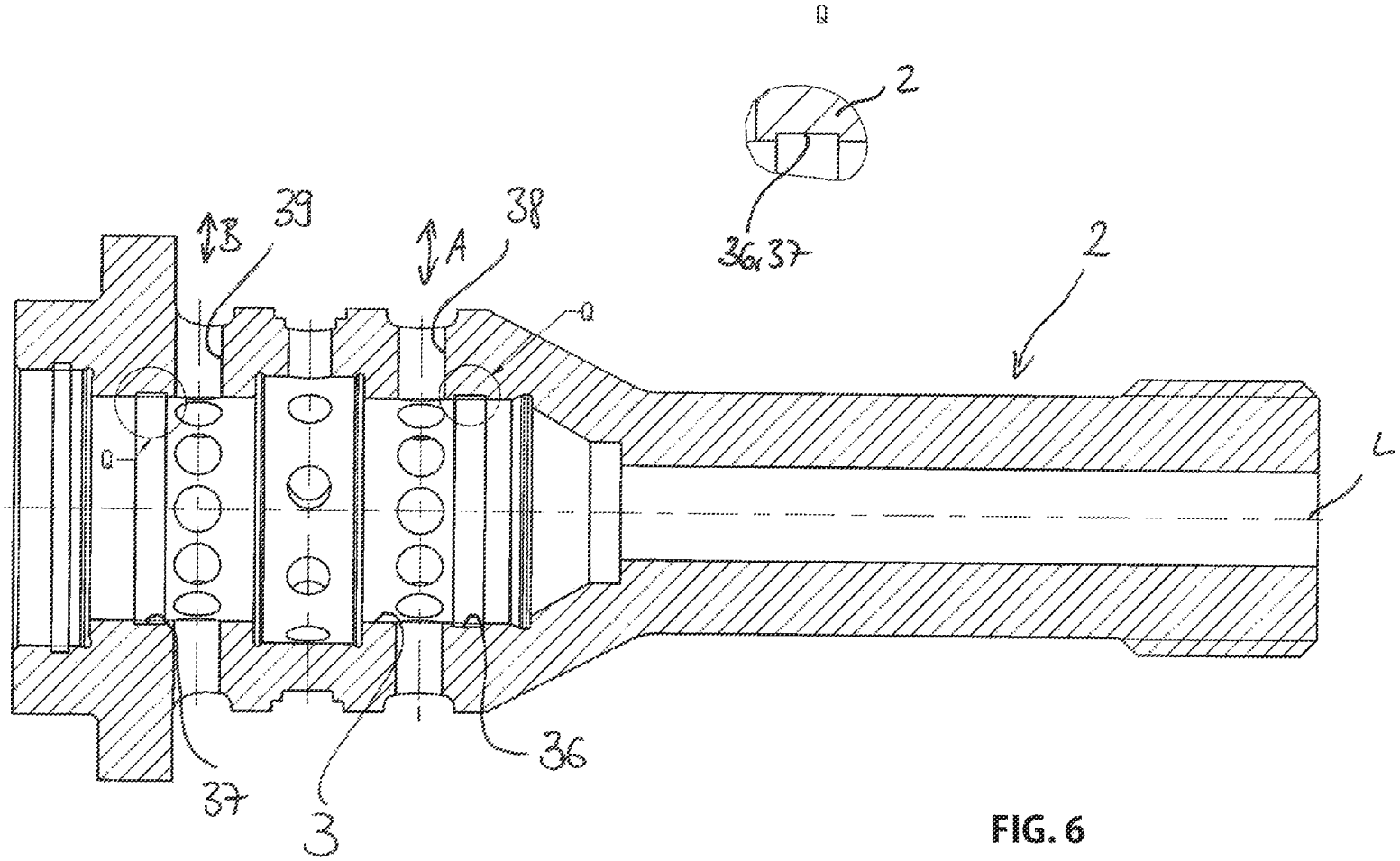
FIG. 6 illustrates the bushing of the hydraulic valve according to FIG. 1 in a longitudinal sectional view.

As evident in particular from FIG. 5 a respective check valve 15, 16 on the outside of the piston 4 is respectively associated with the first operating connection A and the second operating connection B. The check valves are respectively arranged at the piston attachments 18, 19 which envelop the piston 4 and which are connected in a rigid manner with the piston 4 e.g. by a press fit or by welding. This facilitates a compact configuration of the hydraulic valve and a simple and economical configuration of the piston assembly 20.

The check valves 15, 16 are respectively provided as disc shaped closing elements which are preloaded by a common compression spring 21 against the piston attachments 18, 19 and thus close openings 22, 23 through which hydraulic fluid is conductible through the check valves 15, 16 starting with the pressure threshold value described supra. Thus, a preassembled piston assembly 20 can be advantageously provided which can be installed in the bushing 2 in a simple manner.

Axial protrusions 46, 47 of the check valves 15, 16 facilitate a secure axial movement on the piston 4.

The piston attachments 18, 19 respectively include two inner annular bars 24, 26 and two outer annular bars 25, 27 which respectively include two control edges 28, 29, 30, 31, 32, 33, 34, 35 which cooperate with recesses in the bushing 2. Through the control edges 28-35 the volume flow of the hydraulic fluid can be controlled in an improved manner so that a significant increase of the adjustment speed, in particular in the upper engine speed range and improved force properties can be obtained.

Thus, the control edges 28-35 of the inner and outer annular bars 24-27 cooperate with the operating connections A, B as radial recesses 38, 39 in the bushing 2 and with two groove shaped recesses 36, 37 in the portion of the bore hole 3, wherein the groove shaped recesses 36, 37 are arranged in the axial direction respectively between the operating connection A or B and the associated tank drain connection T1 or T2. The groove shaped recesses 36, 37 facilitate a position dependent opening and closing of the tank drain connections T1, T2 in cooperation with the control edges 28-30 and 33-35 in that a fluid path between the first operating connection A and the second operating connection B or to the first or second tank drain connection T1 or T2 is opened in the switching positions 10 and 14 between the outer annular bars 25 or 27 of the piston attachments 18 or 19 and an inside of the bushing. Thus, the outer annular bar 25 of the first piston attachment 18 is in the portion of the groove shaped recess 36 in the first switching position 10 illustrated in FIG. 1 and a fluid flow between the annular bar 25 and an inner side of the bushing is possible towards the tank drain connection T1. The outer annular bar 27 of the second piston attachment 19, however, is outside of the groove shaped recess 37, so that no fluid flow in a direction towards the tank drain connection T2 is possible through the closed control edges 34, 35.

In the second and in the fourth switching position 11 and 13 of the hydraulic valve 1 the outer annular bars 25 and 27 are arranged outside of the groove shaped recesses 36 and 37 so that no fluid flow is possible in a direction towards the tank drain connections T1 or T2 through the closed control edges 34, 35, 28, 29.

Figure 7:
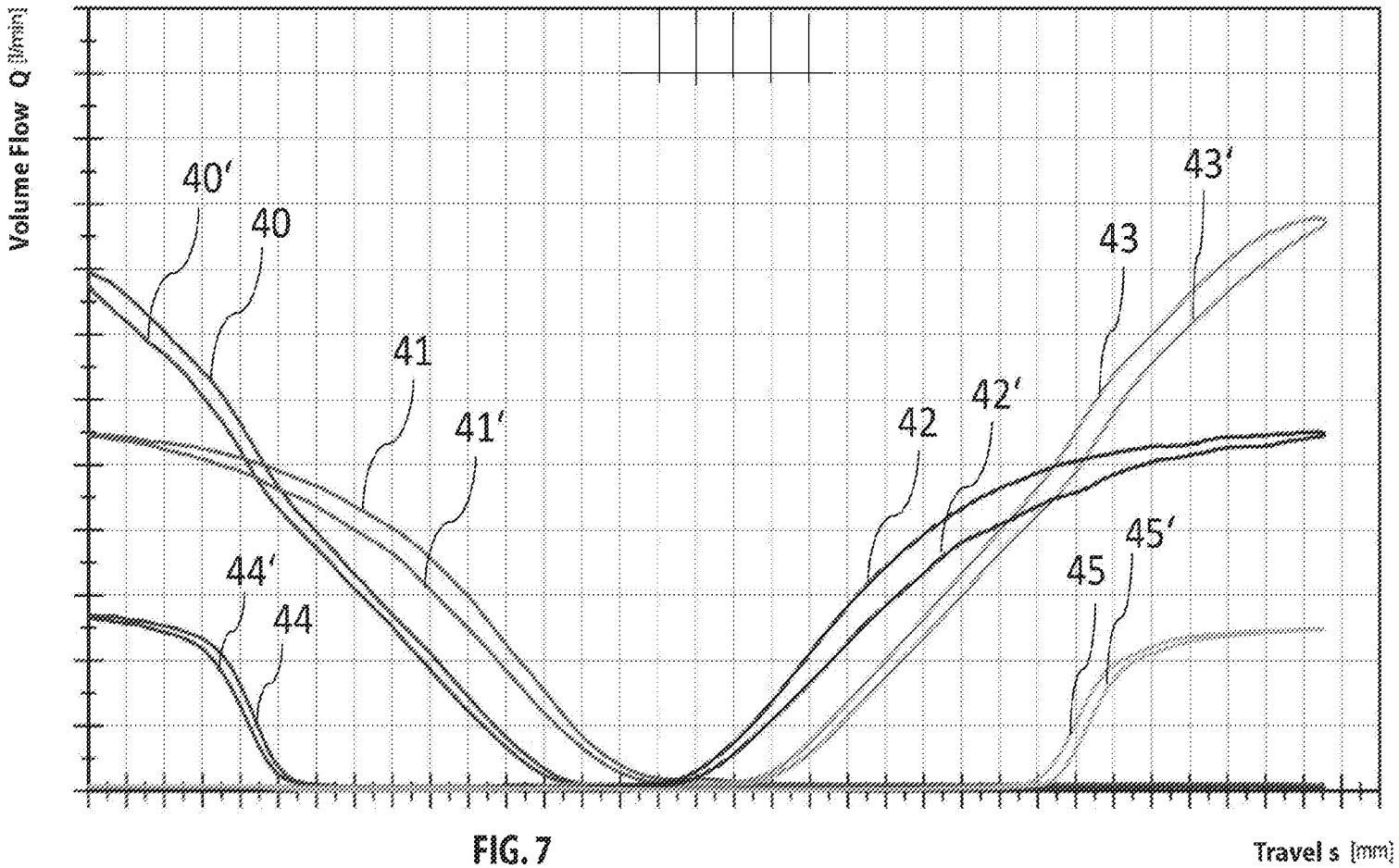
FIG. 7 illustrates the characteristic diagram of the hydraulic valve according to FIG. 1.

FIG. 7 illustrates a characteristic volume flow diagram of the hydraulic valve 1 plotted over valve travel. The volume flow/valve travel characteristic diagram shows the resulting volume flow as a function of a position of the piston 4 (5 switching positions 10-14).

The lines 40 and 40' show the volume flow from A-B and the lines 41 and 41' show the volume flow from P-B during the first and the second switching position 10 and 11.

Approximately after half the total travel the center position 12 is reached where a connection between the operating connections A, and B and the supply connection P and the tank drain connections T1, T2 is completely interrupted.

The lines 42 and 42' show the volume flow from P to A and the lines 43 and 43' show the volume flow from B-A in the fourth and the fifth switching position 13 and 14.

It is evident from the lines 44 and 44' that the connection A to T1 is only open in the first switching position 10. The connection B to T2 is only open in the fifth switching position 14 as illustrated by the lines 45 and 45'.

What is claimed is:

1. A hydraulic valve for a cam phaser, the hydraulic valve comprising:

a bushing including a piston that is movable in a bore along a longitudinal direction;

a supply connection configured to feed a hydraulic fluid;

a first operating connection and a second operating connection; and a first tank drain connection and a second tank drain connection configured to drain the hydraulic fluid; and a first check valve associated with the first operating connection and a second check valve associated with the second operating connection, wherein the first operating connection and the second operating connection are connectable through at least one of the first check valve and the second check valve alternatively with each other or with the supply connection or with one of the first tank drain connection and the second tank drain connection by moving the piston, wherein the hydraulic valve includes five switching positions, wherein the second operating connection is connected with the supply connection and the first operating connection is connected with the first tank drain connection in a first switching position of the piston and a fluid path from the first operating connection to the second operating connection is openable by the first check valve that is associated with the first operating connection under a pressure that exceeds a threshold value, wherein the second operating connection is connected with the supply connection and a connection between the first operating connection and the first tank drain connection is interrupted in a second switching position of the piston and a fluid path from the first operating connection to the second operating connection is openable by the first check valve that is associated with the first operating connection under the pressure that exceeds the threshold value, wherein a connection between the first operating connection, the second operating connection and the supply connection and the first tank drain connection and the second tank drain connection is interrupted in a third switching position of the piston which is positioned in a center position, wherein the first operating connection is connected with the supply connection and a connection between the second operating connection and the second tank drain connection is interrupted in a fourth switching position of the piston and a fluid path from the second operating connection to the first operating connection is openable by the second check valve that is associated with the second operating connection under the pressure that exceeds the threshold value, wherein the first operating connection is connected with the supply connection and the second operating connection is connected with the second tank drain connection in a fifth switching position of the piston and a fluid path from the second operating connection to the first operating connection is openable by the second check valve that is associated with the second operating connection under the pressure that exceeds the threshold value, wherein the first check valve is arranged at a first piston attachment that envelops the piston and that is connected with the piston in a rigid manner, and wherein the second check valve is arranged at a second piston attachment that envelops the piston and that is connected with the piston in a rigid manner.

2. The hydraulic valve according to claim 1, wherein the first operating connection is associated with the first check valve on an outside of the piston and the second operating connection is associated with the second check valve on the outside of the piston.

3. The hydraulic valve according to claim 1, wherein the first check valve is provided as disc shaped closing element that is preloaded against the first piston attachment by a common compression spring, and wherein the second check valve is provided as disc shaped closing element that is preloaded against the second piston attachment by the common compression spring.

4. The hydraulic valve according to claim 1, wherein the first piston attachment includes two first annular bars which respectively include two first control edges that respectively cooperate with two recesses in the bushing, and wherein the second piston attachment includes two second annular bars which respectively include two second control edges that respectively cooperate with the two recesses in the bushing.

5. The hydraulic valve according to claim 4, wherein the first control edges of the first annular bars and the second control edges of the second annular bars cooperate with the first operating connection and the second operating connection configured as radial recesses in the bushing and with two groove shaped recesses in a portion of the bore, wherein the two groove shaped recesses are arranged in the axial direction respectively between the first operating connection and the associated first tank drain connection and the second operating connection and the associated second tank drain connection.

6. A cam phaser with the hydraulic valve according to claim 1, wherein the hydraulic valve is configured as a central valve.

7. A hydraulic valve for a cam phaser, the hydraulic valve comprising:

a bushing including a piston that is movable in a bore along a longitudinal direction between a first end position and a second end position;

a supply connection for feeding a hydraulic fluid;

a first operating connection and a second operating connection; and a first tank drain connection and a second tank drain connection configured to drain the hydraulic fluid, wherein the first operating connection and the second operating connection are in fluid communication with each other by positioning of the piston, and wherein the piston includes two outer annular bars that are arranged at axially exterior ends of the piston and configured to completely close the second tank drain connection in the first end position and to completely close the first tank drain connection in the second end position, wherein an entirety of a first outer annular bar of the two outer annular bars is arranged in the longitudinal direction between the first operating connection and the first tank drain connection when the first outer annular bar completely closes the first tank drain connection in the second end position, wherein an entirety of a second outer annular bar of the two outer annular bars is arranged in the longitudinal direction between the second operating connection and the second tank drain connection when the second outer annular bar completely closes the second tank drain connection in the first end position, and wherein groove shaped recesses are arranged in the longitudinal direction respectively between the first operating connection and the associated first tank drain connection and between the second operating connection and the associated second tank drain connection wherein an entirety of a first groove shaped recess of the groove shaped recesses is arranged in the longitudinal direction between the first operating connection and the first tank drain connection, wherein an entirety of a second groove shaped recess of the groove shaped recesses is arranged in the longitudinal direction between the second operating connection and the second tank drain connection, wherein the entirety of the first outer annular bar is arranged in the longitudinal direction between the first groove shaped recess and the first tank drain connection when the first outer annular bar completely closes the first tank drain connection in the second end position, wherein the entirety of the second outer annular bar is arranged in the longitudinal direction between the second groove shaped recess and the second tank drain connection when the second outer annular bar completely closes the second tank drain connection in the first end position.

8. The hydraulic valve according to claim 7, wherein the bushing includes two groove shaped recesses in a portion of the bore, and wherein the groove shaped recesses are respectively associated with the outer annular bars.

9. The hydraulic valve according to claim 7, wherein the piston includes two inner annular bars between the two outer annular bars, and wherein the two inner annular bars are respectively associated with the first operating connection and the second operating connection.

10. The hydraulic valve according to claim 7, wherein the piston is movable into a first position where the first tank drain connection and the second tank drain connection are closed by the outer annular bars and the second operating connection is in fluid communication with the supply connection and the first operating connection is in fluid communication with the second operating connection.

11. A hydraulic valve for a cam phaser, the hydraulic valve comprising:

a bushing including a piston that is movable in a bore along a longitudinal direction between a first end position and a second end position;

a supply connection for feeding a hydraulic fluid;

a first operating connection and a second operating connection; and a first tank drain connection and a second tank drain connection configured to drain the hydraulic fluid, wherein the first operating connection and the second operating connection are in fluid communication with each other by positioning of the piston, and wherein the piston includes two outer annular bars that are arranged at axially exterior ends of the piston and configured to completely close the second tank drain connection in the first end position and to completely close the first tank drain connection in the second end position, wherein groove shaped recesses are arranged in the longitudinal direction respectively between the first operating connection and the associated first tank drain connection and between the second operating connection and the associated second tank drain connection, wherein the piston includes two inner annular bars between the two outer annular bars, wherein the two inner annular bars are respectively associated with the first operating connection and the second operating connection, and wherein the piston is movable into a second position where the first tank drain connection and the second tank drain connection are closed by the two outer annular bars and the first operating connection and the second operating connection are respectively closed by the two inner annular bars.

12. The hydraulic valve according to claim 11, wherein the piston is movable into a third switching position where the first tank drain connection and the second tank drain connection are closed by the outer annular bars and the first operating connection is in fluid communication with the supply connection and the first operating connection is in fluid communication with the second operating connection.

13. A method for operating the hydraulic valve according to claim 12 in the first end position, wherein the second tank drain connection is completely closed by a second annular bar of the two outer annular bars, wherein the first tank drain connection is opened by an annular gap between a first annular bar of the two outer annular bars and one of the groove shaped recesses and the first operating connection is fluid flow connected with the second operating connection, and wherein the second operating connection is fluid flow connected with the supply connection.

14. The method for operating the hydraulic valve according to claim 13 in the switching third position, wherein the first tank drain connection is completely closed by the first annular bar of the two outer annular bars and the second tank drain connection is completely closed by the second annular bar of the two outer annular bars, wherein the first operating connection is fluid flow connected with the second operating connection, and wherein the first operating connection is fluid flow connected with the supply connection.

15. The method for operating the valve according to claim 13 in the second end position, wherein the first tank drain connection is completely closed by the first annular bar of the two outer annular bars, wherein the second tank drain connection is opened by an annular gap between the second annular bar of the two outer annular bars and another one of the groove shaped recesses, wherein the first operating connection is fluid flow connected with the second operating connection, and the first operating connection is fluid flow connected with the supply connection.

16. The method for operating the hydraulic valve according to claim 13, wherein the piston is moved between the first end position and the second end position in a continuously variable manner.

17. A method for operating the hydraulic valve according to claim 12 in the first end position, wherein the second tank drain connection is completely closed by a second annular bar of the two outer annular bars, wherein the first tank drain connection is opened by an annular gap between a first annular bar of the two outer annular bars and one of the groove shaped recesses and the first operating connection is fluid flow connected with the second operating connection, wherein the second operating connection is fluid flow connected with the supply connection, wherein the first tank drain connection is completely closed by the first annular bar of the two outer annular bars and the second tank drain connection is completely closed by the second annular bar of the two outer annular bars, wherein the first operating connection is fluid flow connected with the second operating connection, and wherein the second operating connection is fluid flow connected with the supply connection.

18. A method for operating the hydraulic valve according to claim 12 in the first end position, wherein the second tank drain connection is completely closed by a second annular bar of the two outer annular bars, wherein the first tank drain connection is opened by an annular gap between a first annular bar of the two outer annular bars and one of the groove shaped recesses and the first operating connection is fluid flow connected with the second operating connection, wherein the second operating connection is fluid flow connected with the supply connection, wherein the first tank drain connection is completely closed by the first annular bar of the two outer annular bars and second tank drain connection is completely closed by the second annular bar of the two outer annular bars, and wherein the first operating connection is closed for the fluid flow by a first annular bar of the two inner annular bars and the second operating connection is closed for the fluid flow by a second annular bar of the two inner annular bars.

* * * * *